US006983626B2

(12) United States Patent
Okamoto

(10) Patent No.: US 6,983,626 B2
(45) Date of Patent: Jan. 10, 2006

(54) METHOD OF KNITTING TUBULAR KNITTED FABRIC

(75) Inventor: Kazuyoshi Okamoto, Wakayama (JP)

(73) Assignee: Shima Seiki Mfg., Ltd., Wakayama (JP)

( * ) Notice: Subject to any disclaimer, the term of this patent is extended or adjusted under 35 U.S.C. 154(b) by 0 days.

(21) Appl. No.: 10/525,765

(22) PCT Filed: Aug. 25, 2003

(86) PCT No.: PCT/JP03/10720

§ 371 (c)(1),
(2), (4) Date: Feb. 28, 2005

(87) PCT Pub. No.: WO2004/020720

PCT Pub. Date: Mar. 11, 2004

(65) Prior Publication Data

US 2005/0229641 A1 Oct. 20, 2005

(30) Foreign Application Priority Data

Aug. 29, 2002 (JP) ..... 2002-252067

(51) Int. Cl.
*D04B 7/00* (2006.01)

(52) U.S. Cl. ..... 66/69; 66/70; 66/64

(58) Field of Classification Search ..... 66/60 R, 66/64, 69, 66, 67, 70
See application file for complete search history.

(56) References Cited

U.S. PATENT DOCUMENTS 4,548,057 A * 10/1985 Essig ..... 66/172 R
5,417,088 A * 5/1995 Nakai ..... 66/76
5,456,096 A * 10/1995 Mitsumoto et al. ..... 66/69
5,956,975 A * 9/1999 Kawashima ..... 66/64
6,766,666 B2 * 7/2004 Okamoto ..... 66/64
6,892,555 B2 * 5/2005 Kubo et al. ..... 66/64

FOREIGN PATENT DOCUMENTS

EP 698679 A1 2/1996

(Continued)

*Primary Examiner*—Danny Worrell
(74) *Attorney, Agent, or Firm*—Rothwell, Figg, Ernst & Manbeck, P.C.

(57) ABSTRACT

A tubular knitted fabric (11) having a first knitted fabric and a second knitted fabric joined together continuously at both ends thereof and a laminating part (4) formed in the first knitted fabric at which the knitted fabric is partly laminated in two or more layers is knitted by the method comprising the step of forming the tubular knitted fabric via a full-gauge loop arrangement, the knitting width widening step (s3) of shifting loops of wale where the laminating part (4) is formed and loops of wale positioned closer to a side end of the knitted fabric than the wale where the laminating part (4) is formed, to provide a half-gauge loop arrangement wherein empty needles for stitch transfer are arranged between needles used for forming the loops of the wale where the laminating part (4) is formed, and the step (s4) of knitting the first knitted fabric and the second knitted fabric, while the loops of wale where the laminating part (4) is formed are formed to be fine in size so that when the knitting is ended, the loops of wale where the laminating part (4) is formed can be substantially equal in size to the loops in other region than the loops of wale where the laminating part (4) is formed. This can prevent texture differences between the respective knitted fabric parts including the laminating part (4) at which the knitting fabric is partly laminated in multilayer.

5 Claims, 16 Drawing Sheets

FOREIGN PATENT DOCUMENTS

| | | | |
|---|---|---|---|
| JP | 3-75656 | B2 | 12/1991 |
| JP | 2958697 | B2 | 10/1999 |
| JP | 3140990 | B2 | 3/2001 |
| JP | 2003-73961 | A | 3/2003 |

* cited by examiner

METHOD OF KNITTING TUBULAR KNITTED FABRIC

CROSS REFERENCE TO RELATED APPLICATION

This application is a 35 USC § 371 National Phase Entry Application from PCT/JP2003/010720, filed Aug. 25, 2003, and designating the United States.

TECHNICAL FIELD

The present invention relates to a method of knitting on a flat knitting machine a tubular knitted fabric comprising first and second knitted fabrics joined together continuously at both ends thereof, and a laminating part formed in the first knitted fabric in which the knitted fabric is partly laminated in at least two layers.

BACKGROUND ART

The knitting technique of joining together knitted fabrics knitted on a flat knitting machine during the knitting process can eliminate or simplify the subsequent sawing process. For example, this knitting technique can be used to knit a knitted fabric having a laminated-in-three-layer part, such as, for example, a vest having a pocket formed in the front body, formed by a pocket knitted fabric part, an interior knitted fabric part of the pocket laminated with the pocket knitted fabric part, and a back body being laminated in three layers. The knitted fabric which is wholly knitted on the flat knitting machine, including a pocket and a neck, to eliminate the need of the sawing process is called a seamless knit.

The method of knitting a knitted fabric of which front and back bodies are joined together continuously at both ends thereof in the form of a tubular knitted fabric and also knitting a three-layer knitted fabric for the pocket to be formed in the front body by using a four-bed flat knitting machine comprising a pair of front and back needle beds arranged opposite to each other and another pair of upper needle beds arranged over them is known. A knitting technique, which is called a half-gauge knitting, is used to knit this knitted fabric having the pocket formed therein. The half-gauge knitting is a knitting method that, for example, loops of a front knitted fabric are allocated to odd needles of the front and back needle beds and loops of a back knitted fabric are allocated to even needles thereof, so that when the front knitted fabric is knitted, all loops of the back knitted fabric are supplied to the even needles on the back needle bed, while on the other hand, when the back knitted fabric is knitted, all loops of the front knitted fabric are supplied to the odd needles on the front needle bed, for the knitting of the knitted fabric.

When the knitted fabric having a laminating part laminated in three layers at the pocket is knitted by the half-gauge knitting, there are some possible ways. One is that a front pocket part and a back pocket part hidden behind the front pocket part are knitted in the density one-half the total gauges of the knitted fabric part around the pocket (one wale for every two needles). In this knitting, the knitted fabric is knitted to a location at which the formation of the pocket starts via a full-gauge loop arrangement wherein the empty needles for loop transfer are not arranged between the needles for loop formation. At the location where the formation of the pocket starts, the needles for knitting the front knitted fabric are alternately sorted between the needles for knitting the pocket knitted fabric part and the needles for forming the interior knitted fabric part of the pocket hidden behind the pocket knitted fabric part, for the knitting of the pocket. In this knitting, the pocket knitted fabric part and the interior knitted fabric part of the pocket are formed in the state of being laminated in two layers with alternate needles, respectively. Hence, the number of wale of the pocket knitted fabric part and the number of wale of the interior knitted fabric part of the pocket are reduced to one-half of the original number of wale. In the knitted fabric knitted in this way, sinker loops of the pocket knitted fabric part and the interior knitted fabric part are stretched largely, as compared with the surrounding part, so that the knitted fabric apparently has a coarse mesh, causing significant reduction in value of commodity. Another one is that the pocket knitted fabric part is knitted separately without forming the pocket on the knitting machine and the pocket knitted fabric part is stitched to the knitted fabric by sawing. This knitting produces an increased number of processes, causing cost increase, however.

There is a still another possible way that the whole knitted fabric including the pocket is knitted via the half-gauge knitting so that both the pocket part and the remaining parts are knitted in the same density. However, this knitting requires increased number of needles for the knitting and the knitted fabric cannot be knitted without using a large knitting machine having a corresponding needle bed length. Besides, the knitted fabric knitted becomes limp and poor in texture. Also, when a three-layer or four-layer knitted fabric is knitted on a two-bed flat knitting machine, such a knitted fabric is knitted via such a loop arrangement in which needles used for knitting such a knitted fabric are in a ratio of one to three or one to four. The two-bed flat knitting machine requires a longer needle bed for knitting the same knitted fabric than the four-bed flat knitting machine does, thus requiring increased number of needles required for the knitting. In addition, the two-bed flat knitting machine provides a more significant disadvantage of producing a sinker loop too much larger than a needle loop, than the four-bed flat knitting machine does.

In the light of the disadvantages mentioned above, the present invention has been made. It is an object of the present invention to disclose a knitting method that can allow the knitting of a knitted fabric including a laminating part in which the knitting fabric is partly laminated in multilayer, without providing texture differences between the parts knitted via different loop arrangements, using a shorter flat knitting machine than that used in the conventional knitting method.

DISCLOSURE OF THE INVENTION

To accomplish the object mentioned above, the present invention provides a method of knitting a tubular knitted fabric comprising a first knitted fabric and a second knitted fabric joined together continuously at both ends thereof, and a laminating part formed in the first knitted fabric at which the knitted fabric is partly laminated in at least two layers by using a flat knitting machine comprising having at least a pair of front and back needle beds which extend laterally and are arranged opposite to each other and have a large number of needles respectively and at least one of which can be racked rightward and leftward to transfer loops between the needles beds, the method comprising:

1) the step of forming the tubular knitted fabric via a full-gauge loop arrangement,
2) the knitting width widening step of shifting loops of wale where the laminating part is formed and loops of wale positioned closer to a side end of the knitted fabric than the wale where the laminating part is formed, to provide a half-gauge loop arrangement wherein empty needles for stitch transfer are arranged between needles used for forming the loops of the wale where the laminating part is formed, and 3) the step of knitting the first knitted fabric and the second knitted fabric, while the loops of wale where the laminating part is formed are formed to be fine in size so that when the knitting is ended, the loops of wale where the laminating part is formed can be substantially equal in size to the loops in other regions than the wale where the laminating part is formed, to provide the same texture as the loops other than those of the laminating layer part.

According to the construction of the present invention, the tubular knitted fabric comprising the first knitted fabric and the second knitted fabric joined together continuously at both ends thereof is knitted by a usual knitting method adopted for knitting the tubular knitted fabric. The usual knitting method is a tubular knitted fabric knitting method using the half-gauge knitting for the two-bed flat knitting machine comprising a pair of front and back needle beds or a knitting method using the full-gauge knitting wherein the knitting is performed without the empty needles for loop transfer being arranged between the loop forming needles, for the four-bed flat knitting machine comprising upper needle beds arranged over the pair of front and back needle beds. Before the formation of the laminating part, the loops of the laminating part which is in the full-gauge loop arrangement is changed to the half-gauge loop arrangement. The loops in the laminating part and the loops positioned closer to the side end of the knitted fabric than these loops are transferred to their respective opposite needle beds and then at least either of the front and back needle beds is racked. Then, whenever the needle bed is racked at an appropriate pitch, the loops of the laminating part are returned to the original needle bed. Then, the racking of the needle beds and the returning of the loops are repeated to provide the half-gauge loop arrangement in which the loops of the laminating part are retained on needles, one for every appropriate number of needles. The term, every appropriate number of needles, is intended to include the state of the loops being retained on every two needles when the knitted fabric is knitted in three layers via the half-gauge knitting using the two-bed flat knitting machine, and the state of the loops being retained on every three needles when the knitted fabric is knitted in four layers. For the four-bed flat knitting machine, it indicates the state of the loops being retained on every other needle. The needle arrangements of every other needle, every two needles, and every three needles are the minimum needles required. Unless the texture of the knitted fabric is spoiled when the wales are knitted at further spaced intervals, then the knitted fabric can be knitted at such further spaced intervals.

Sequentially, the loops newly formed in the laminating part serving as the set-up of the knitted fabric are formed by the empty needles provided in the laminating part by the above-said knitting. When the laminating part is knitted in two layers (three layers in total when combined with the second knitted fabric part), the number of loops required for a single layer are formed. When the laminating part is knitted in three layers (four layers in total when combined with the second knitted fabric part), the number of loops required for a single layer are additionally formed in advance. Then, after those loops are moved to locations not to cause an obstruction to the knitting, the number of loops required for another layer are formed. Then, three- to four-layer knitted fabrics are knitted, while the loops between the front and back needle beds that may cause an obstruction to the knitting are moved to their respective opposite needle beds.

At this time, the loops of the laminating part are formed in the form of fine loop so that when the knitting is ended, the loops of the laminating part can be substantially equal in size to the loops in the other parts than the laminating part. This can provide the same stitch loop texture between the knitted fabric part formed via the half-gauge knitting and the remaining knitted fabric parts formed via the full-gauge knitting.

It is one of the characteristic features that in the knitting width widening step, the loops of wale where the laminating part is formed and the loops positioned closer to a side end of the knitted fabric than the wale where the laminating part is formed are shifted at a location at which formation of the laminating part starts, so that the loops of wale where the laminating part is formed are put in the half-gauge loop arrangement wherein the empty needles for stitch transfer are arranged between the needles used for forming the loops of the wale where the laminating part is formed.

It is one of the characteristic features that after completion of the knitting of the laminating part, a knitting width narrowing step is taken to return the loops of the laminating part to the full-gauge loop arrangement.

It is one of the characteristic features that the loops of wale where the laminating part of the first knitted fabric is formed; the loops positioned closer to the side end of the knitted fabric than the wale where the laminating part is formed; loops of wale at a portion thereof confronting the laminating part of the second knitted fabric; and the loops of wale positioned closer to the side end of the knitted fabric than the wale at a portion thereof confronting the laminating part are transferred to their respective opposite needle beds and then at least any one of the front and needle beds is racked, so that whenever the needle bed is racked a predetermined pitch, the loops of wale where the laminating part of the first knitted fabric is formed and the loops of wale at a portion thereof confronting the wale where the laminating part of the second knitted fabric is formed are returned to their respective original needle beds, so that the loops of the wale where the laminating part is formed and the loops of wale at the portion thereof confronting the laminating part are put in the half-gauge loop arrangement.

Also, it is one of the characteristic features that the knitting width widening step and/or the knitting width narrowing step includes the feed knitting step that loops of the knitted fabric on the side thereof on which the knitting width is larger or will be larger are sequentially transferred to respective positions at the outside of the loops at the side end of the knitted fabric retained on the other needle bed from the loop at the side end of the knitted fabric and then the loops are shifted to prevent increase of difference in knitting width between the first knitted fabric and the second knitted fabric.

BRIEF DESCRIPTION OF THE DRAWINGS

FIG. 1(*b*) shows a sectional view of FIG. 1(*a*) taken along line X—X as viewed from an arrowed direction. FIG. 1(*c*) shows change in knitting width of the tights 1 on the needle bed. FIG. 1(*d*) shows a loop arrangement for knitting a laminating part.

FIG. 10(*b*) shows a sectional view of FIG. 10(*a*) taken along line Y—Y as viewed from an arrowed direction. FIG. 10(*c*) shows change in knitting width of the tubular knitted fabric 11 on the needle bed. FIG. 10(*d*) shows a loop arrangement for knitting a laminating part.

BEST MODE FOR CARRYING OUT THE INVENTION

Figure 1:
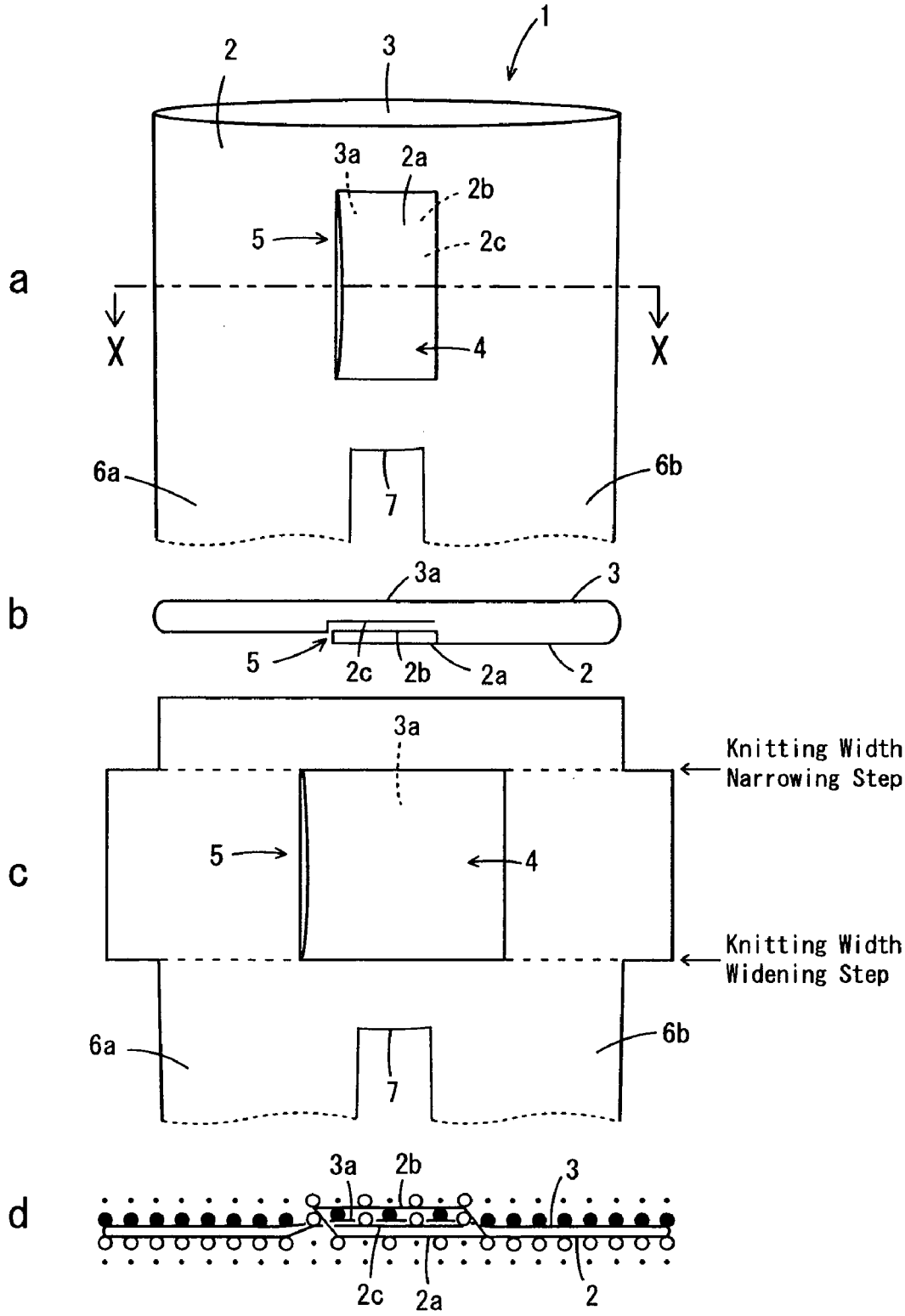
FIG. 1(*a*) shows tights 1.
Figure 2:
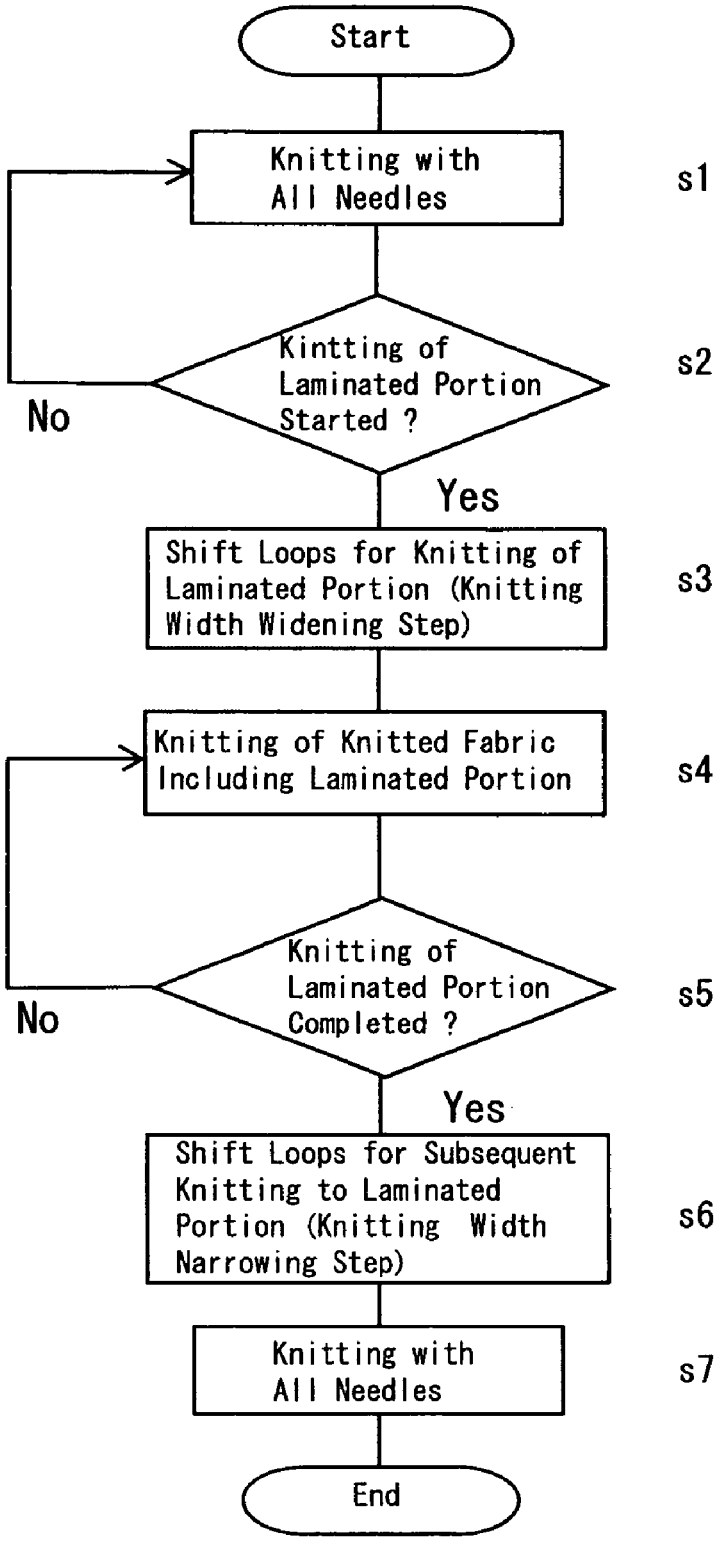
FIG. 2 shows a flow chart representing the sequence of the knitting.
Figure 3:
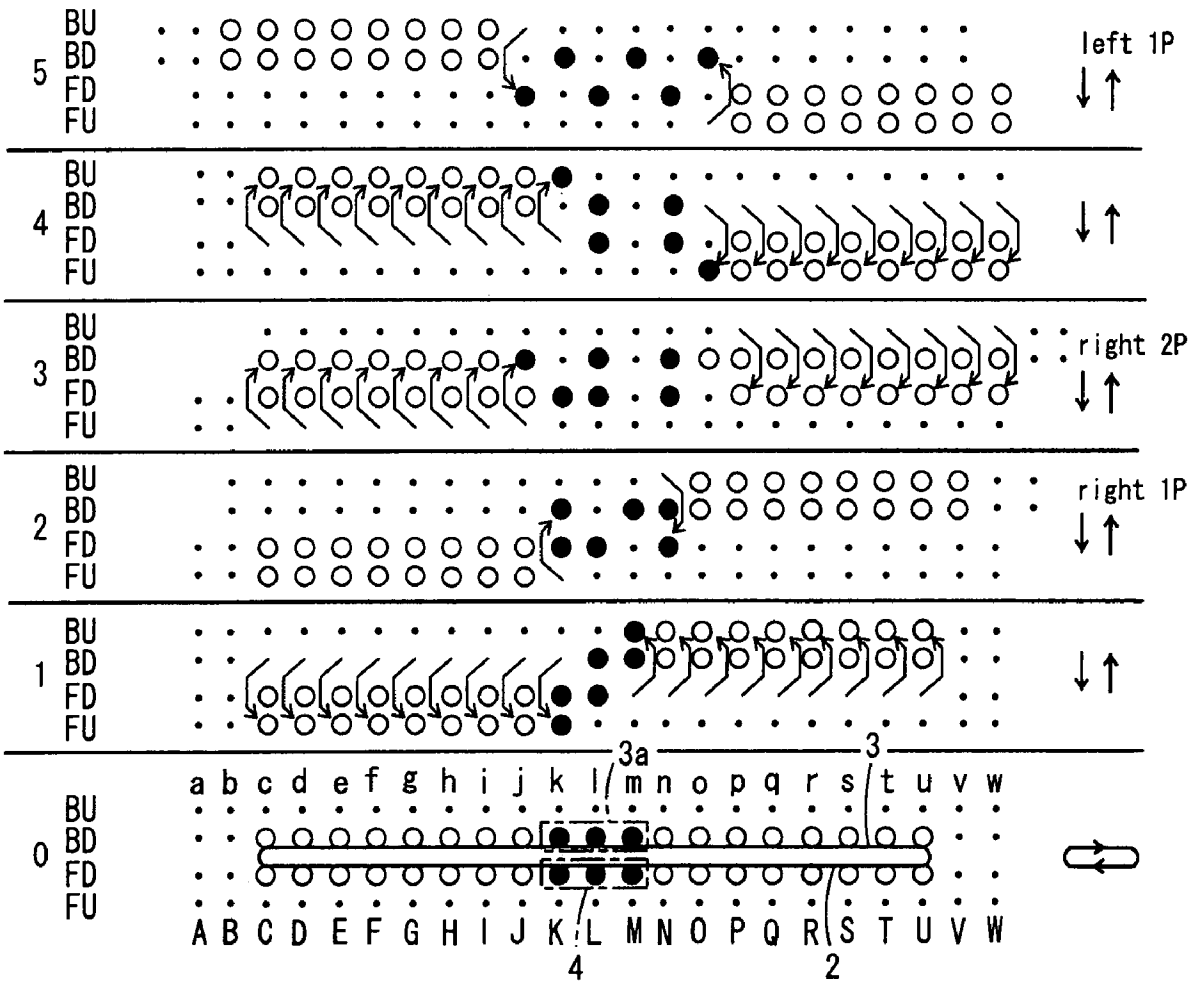
FIGS. 3–9 show knitting course diagrams illustrated in the first embodiment.
Figure 4:
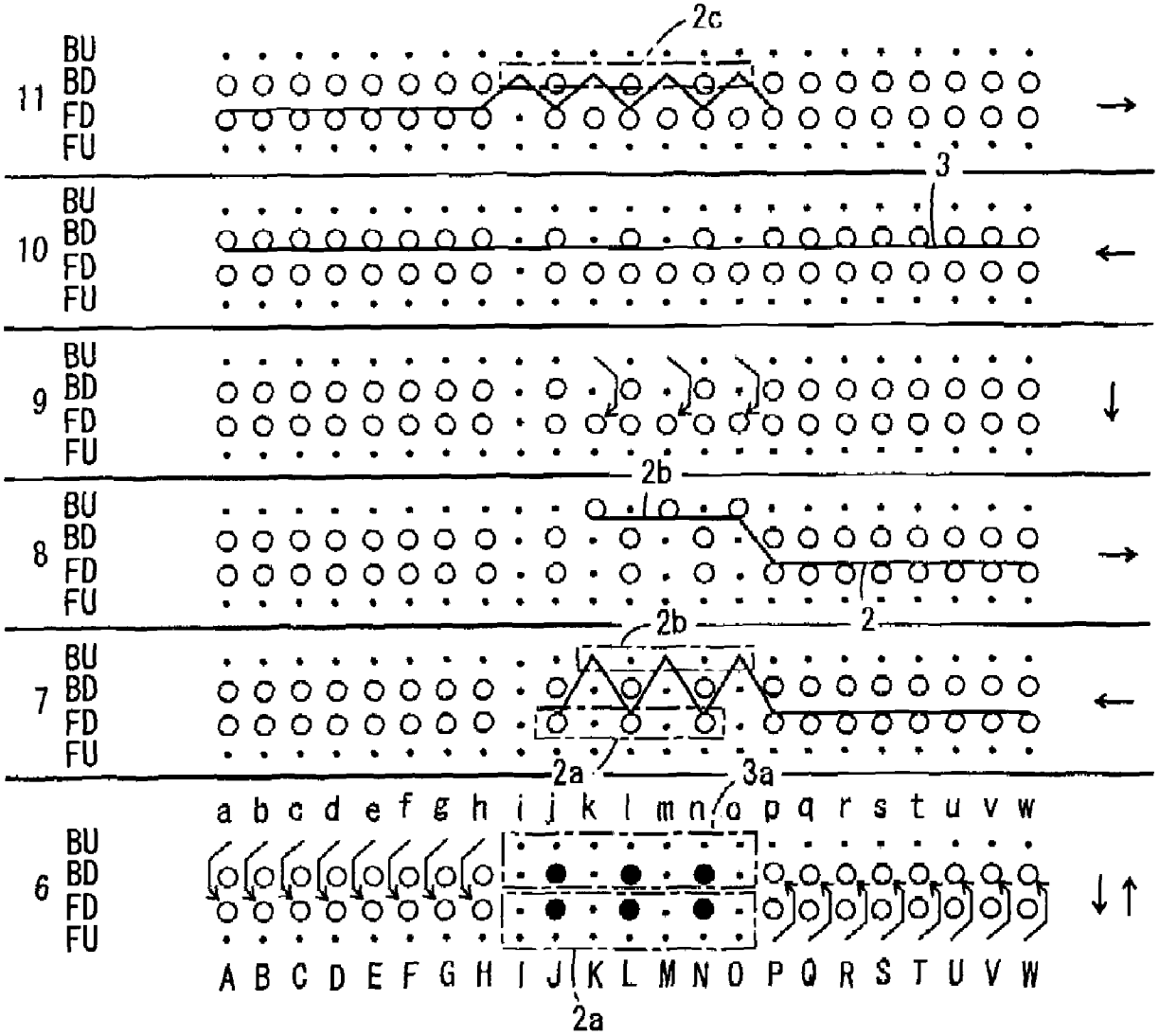
Figure 5:
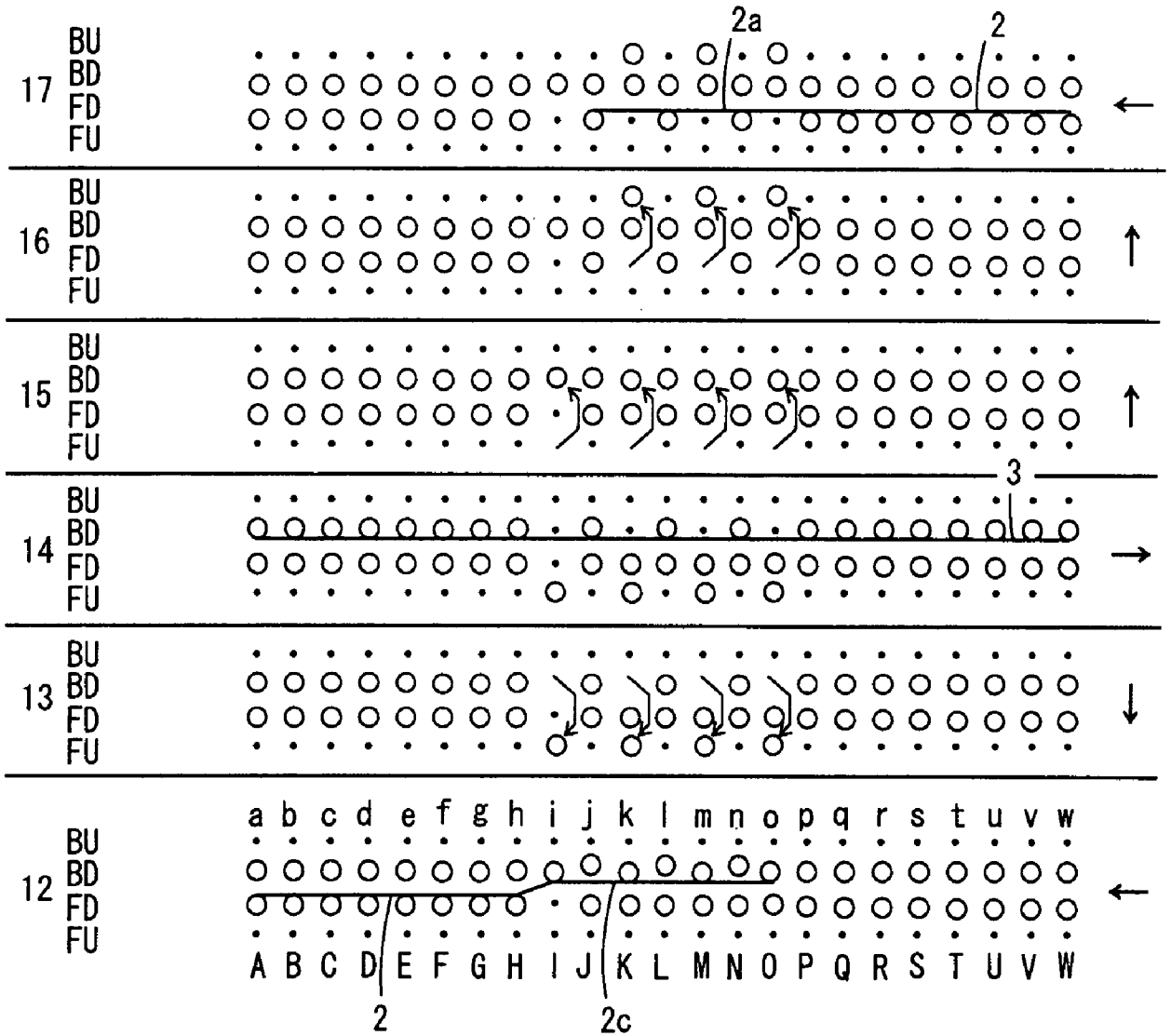
Figure 6:
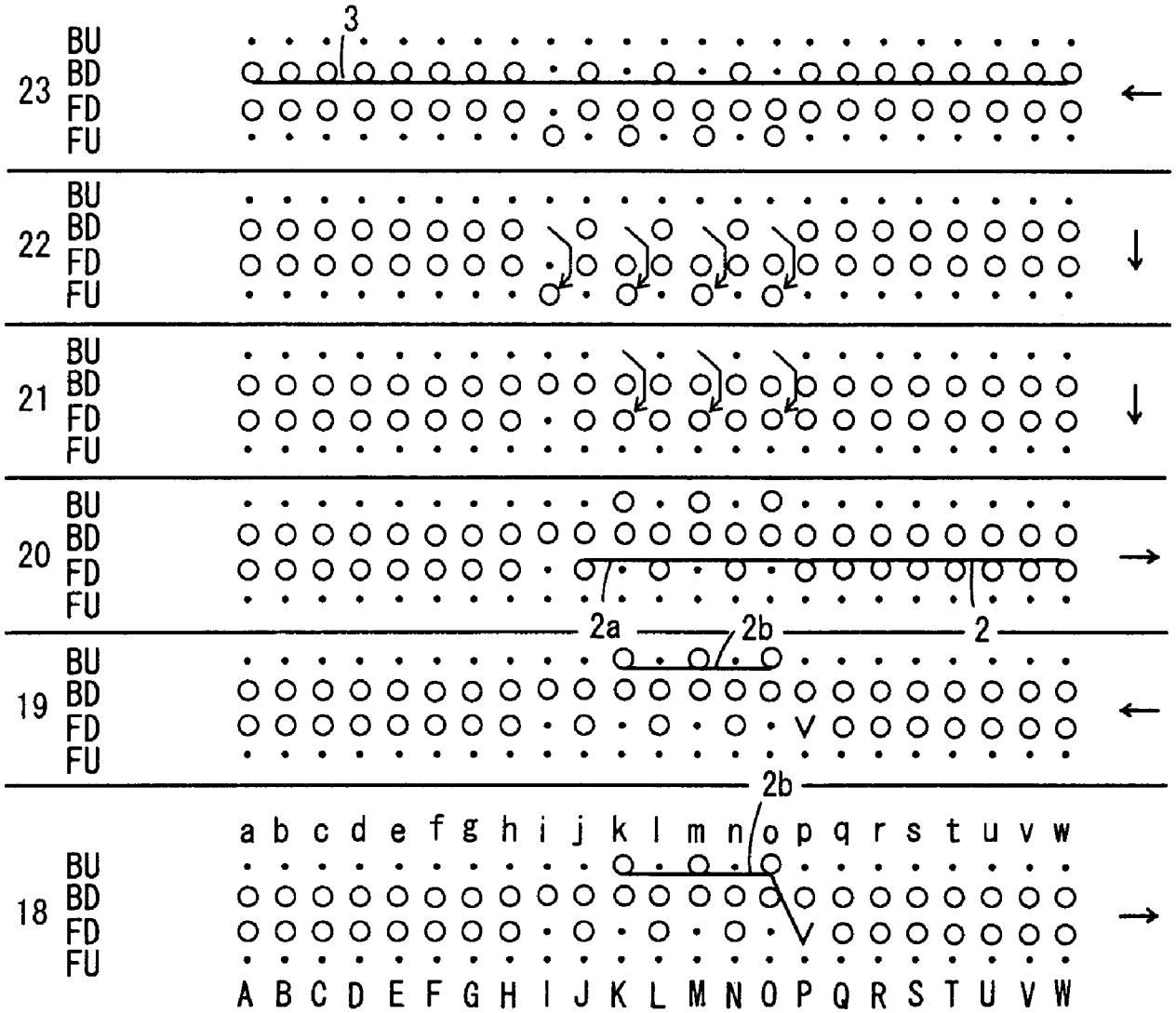
Figure 7:
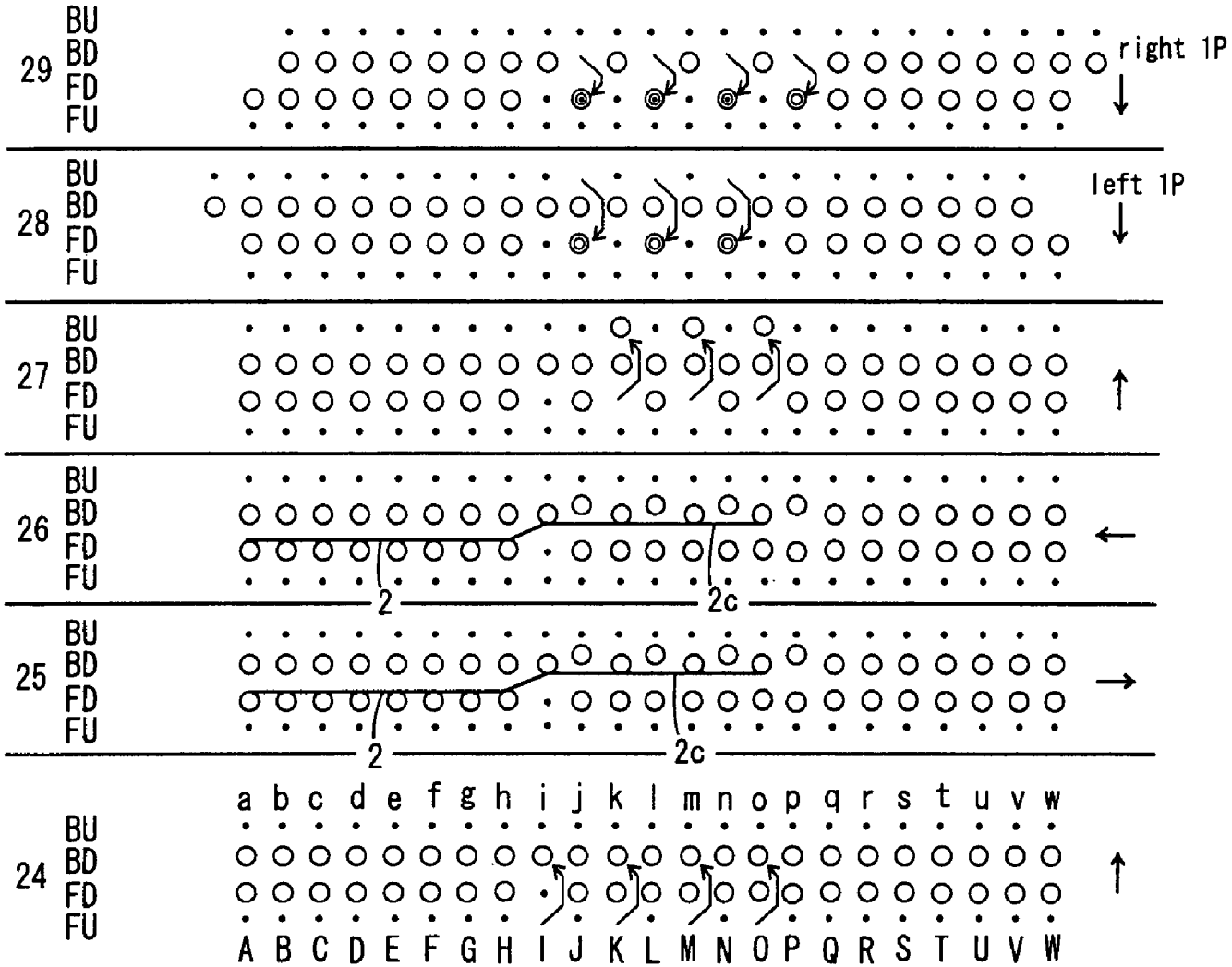
Figure 8:
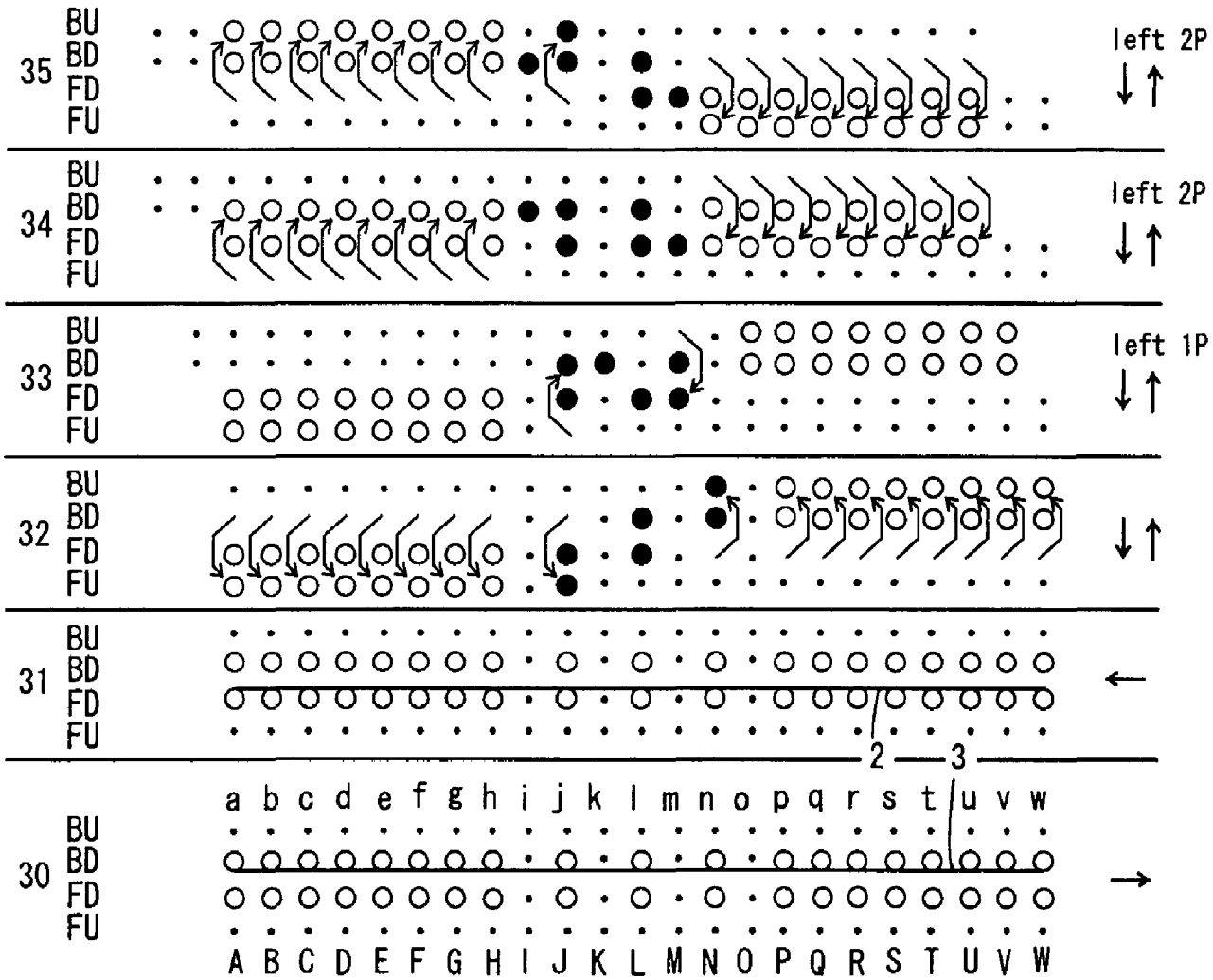
Figure 9:
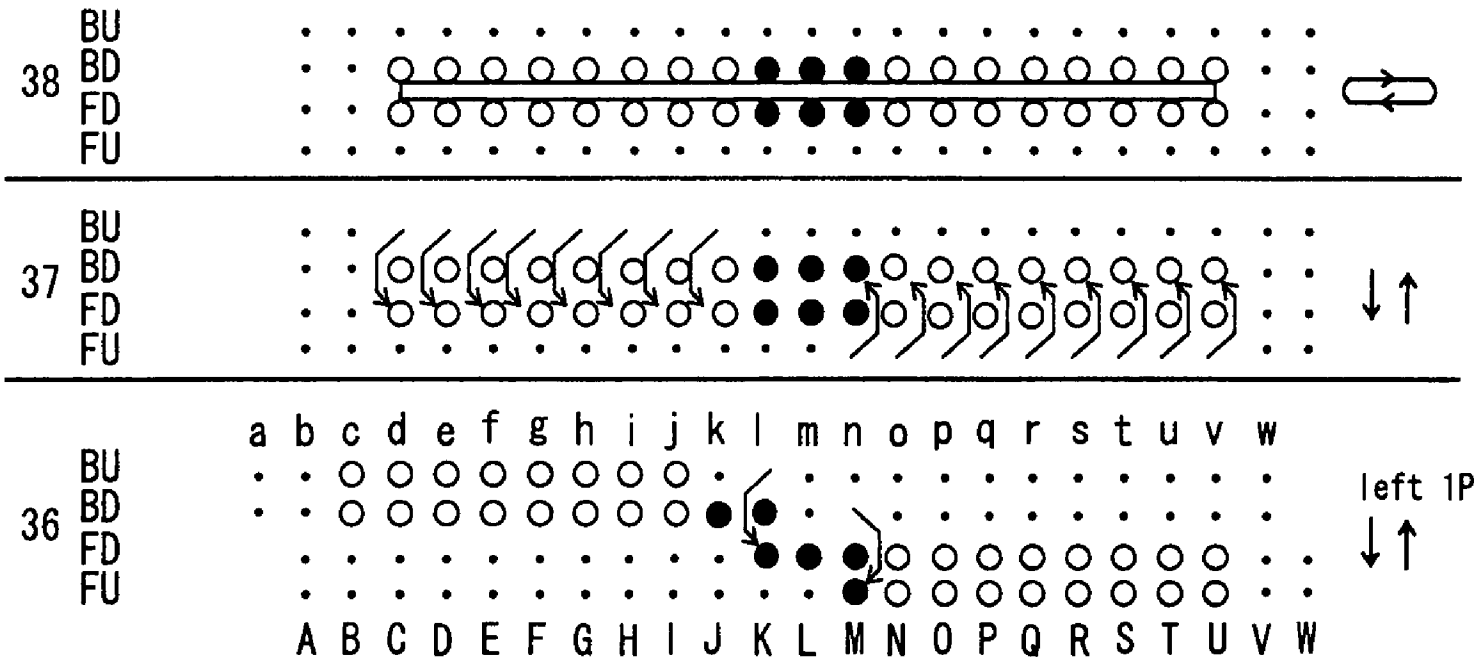

A first embodiment of the present invention will be described in detail with reference to the accompanying drawings. A tights 1 having an opening 5 is knitted in the first embodiment. FIG. 1-*a* shows the tights 1 knitted in the first embodiment. FIG. 1-*b* is a sectional view of FIG. 1-*a* taken along line X—X as viewed from an arrowed direction. FIG. 1-*c* is a view showing change in knitting width of the tights 1 on the needle bed. FIG. 1-*d* is a view showing a loop arrangement for knitting an laminating part. FIG. 2 is a flow chart representing the sequence of the knitting. FIGS. 3–9 are knitting course diagrams showing the first embodiment. The knitting of the tights 1 in the first embodiment starts at tiptoes, not shown. Left and right leg parts 6*a*, 6*b* are knitted concurrently from the tiptoe side. A region extending between the left and right leg parts 6*a*, 6*b* is set up at the gore 7. Subsequently, left and right leg parts 6*a*, 6*b* and the gore part 7 are joined together to form a single tubular knitted fabric. An opening 5 is formed in the front knitted fabric 2. A laminating part 4 comprising a surface layer part 2*a*, an intermediate layer part 2*b*, and a base layer part 2*c* laminated in three layers is formed at the opening 5. The surface layer part 2*a* and the intermediate layer part 2*b* are jointed together continuously at both ends so as to be formed in tubular form. Although the laminating part 4 may be knitted in any desired knitting pattern, the case where the whole knitted fabric is knitted in a plain knitting pattern is described in the illustrated embodiment. For convenience of explanation, an even fewer number of needles used for the knitting than the actual number of needles used for knitting a knitted fabric is illustrated in the embodiment illustrated below.

The knitted fabric of the tights 1 is knitted by a flat knitting machine having at least a pair of front and back needle beds which are arranged opposite to each other and have a large number of needles respectively and at least one of which can be racked rightward and leftward to transfer loops between the needles beds. In the illustrated embodiment, a four-bed flat knitting machine having a front lower needle bed FD, a back lower needle bed BD, a front upper needle bed FU, and a back lower needle bed BU is used. Capital alphabetical letters indicate needles of the front lower needle bed FD and needles of the front upper needle bed FU, respectively. Small alphabetical letters indicate needles of the back lower needle bed BD and needles of the back upper needle bed BU, respectively. Vertical arrows indicate a stitch transfer direction and horizontal arrows indicate a yarn feed direction. Numerals at the right side of the back needle bed indicate racking pitches from an original point shown in the course 0.

First, a rough flow of the knitting is described with reference to FIG. 2. As shown in the course 1 of FIG. 3, before the laminating part 4 is formed, the front knitted fabric part 2 is knitted with needles of the front lower needle bed using a full-gauge loop arrangement, and then the back knitted fabric 3 is knitted with needles of the back lower needle bed using the same full-gauge loop arrangement, these knitting steps being repeatedly taken to knit the knitted fabric in a circular form (s1). Sequentially, after the knitted fabric is knitted to a location where the knitting of the laminating part 4 starts (s2), the loops are transferred to provide a half-gauge loop arrangement for the laminating part 4 only (Knitting width widening step s3). Then, a knitted fabric part including the laminating part 4 is knitted (s4). After completion of the knitting to the final course of the laminating part 4 (s5), the loops are shifted (Knitting width narrowing step (s6)) to return the said arrangement for the laminating part 4 to the full-gauge loop arrangement. Then, the remaining knitted fabric part is knitted via the full-gauge loop arrangement, to knit the tights 1 (s7). It is to be noted that in the case where the knitted fabric is knitted by the four-bed flat knitting machine, the term of "full-gauge loop arrangement" means that no empty needle used for stitch transfer is arranged between the needles used for loop formation of the front knitted fabric part and the back knitted fabric part, and the term of "half-gauge loop arrangement" means that at least one empty needle used for stitch transfer is arranged between the needles used for the loop formation. On the other hand, when a two-layer knitted fabric is knitted by the two-bed flat knitting machine, the front knitted fabric part and the back knitted fabric part are knitted with alternately arranged needles for forming the front knitted fabric part and the back knitted fabric part. Accordingly, in the case where the knitted fabric is knitted by the two-bed flat knitting machine, the term of "full-gauge loop arrangement" means that the needles used for knitting the back knitted fabric part are arranged between the needles used for knitting the front knitted fabric part, and the needles used for knitting the front knitted fabric part are arranged between the needles used for knitting the back knitted fabric part, and the term of "half-gauge loop arrangement" means that in addition to the empty needles for knitting the back knitted fabric part, empty needles used for stitch transfer are arranged between the needles used for knitting the front knitted fabric part, and in addition to the empty needles for knitting the front knitted fabric part, empty needles used for stitch transfer are arranged between the needles used for knitting the back knitted fabric part.

In the following, the first embodiment will be described with reference to FIGS. 3–9. In the first embodiment, the course 0 corresponds to s1; the courses 1–6 correspond to s3; the courses 7–26 correspond to s4; the courses 27–37 correspond to s6, and the course 38 corresponds to s7. The course 0 of FIG. 3 indicates the knitting before the formation of the laminating part 4 starts. The loops of the laminating part 4 and the loops of the back knitted fabric part 3*a* hidden behind the laminating part 4 are depicted by black circles. In this step, a yarn is circularly fed to the needles of both of the front and back needle beds to knit the knitted fabric in a tubular form. Then, the formation of the laminating part 4 starts.

In the course 1, loops on the needles c–k of the back lower needle bed, which are positioned at the left side of the needles L and l positioned in front and back in the center of the knitted fabric, are transferred to the needles C–K of the front upper needle bed, and also loops on the needles M–U of the front lower needle bed FD, which are positioned at the right side of the center of the knitted fabric, are transferred to the needles m–u of the back upper needle bed BU. In the course 2, after the back needle bed is racked rightward one pitch, the loop on the needle K of the front upper needle bed FU is transferred to the needle j of the back lower needle bed, and the loop on the needle m of the back upper needle bed BU is transferred to the needle N of the front lower needle bed FD. As a result of this, the loop of the laminating part 4 and the loop of a part of the back knitted fabric part 3 confronting the laminating part 4 are shifted to the alternate needles, respectively. In the course 3, after the back needle bed is racked rightward two pitches, the loops C–J of the front upper needle bed FU are transferred to the needles a–h of the back lower needle bed, and the loops on the needles n–u of the back upper needle bed BU are transferred to the needles P–W of the front lower needle bed FD. Then, in the course 4, before change of the racking direction, the loops C–K on the front lower needle bed FD are transferred to the needle c–k of the back upper needle bed BU, and the loops on the needles o–w of the back lower needle bed are transferred to the needles O–W of the front upper needle bed FU. In the course 5, the loop on the needle k of the back upper needle bed BU is transferred to the needle J of the front lower needle bed FD, and the loop on the needle O of the front upper needle bed FU is transferred to the needle p of the back lower needle bed. In the course 6, the loops on the needles a–h of the back upper needle bed BU are transferred to the needles A–H of the front lower needle bed FD, and the loops on the needles P–W of the front upper needle bed FU are transferred to the needles p–w of the back lower needle bed BD. At the time of completion of the knitting of the course 6, the loop arrangement of the course 1 is changed to the half-gauge loop arrangement wherein the loops of the laminating part 4 and the loops of the back knitted fabric part 3 to overlap with the loops of the laminating part 4 are retained on the alternate needles, and the loops of the remaining parts are in the full-gauge loop arrangement.

As shown in the courses 1–6, when the laminating part 4 is put in the half-gauge loop arrangement, the loops of the laminating part 4 to be shifted and the loops of the knitted fabric located on the side thereof closer to the laminated part 4 are shifted from the laminating part 4 to the opposite needle beds and, then, after the front and back needle beds are racked, the loops of the laminating part 4 are shifted back to the proper needles, thereby changing the loop arrangement. This knitting can allow the loop arrangement to be changed without any need to repeatedly transfer the same loop between the front and back needle beds. Accordingly, even when the laminating part 4 has a large width and thus a large number of wale, there is no need of repetition of stitch transfer between the front and back needle beds, thus avoiding possible problems of yarn breakage or loop stretch. In addition, each knitting is symmetrically performed with respect to the center of the laminating part 4, and as such can allow the shifting of two stitches on either side for each racking of the needle beds in one direction, thus providing an improved knitting efficiency.

In the course 7, the yarn is fed to the needles W–P of the front lower needle bed FD and also is fed to the needles N, L, J of the front lower needle bed FD and the needles o, m, k of the back upper needle bed BU, to form new loops of the intermediate layer part 2*b* on the needles k, m, o of the back upper needle bed. The needles N, L, J are used for a knit, and the needles o, m, k are used for an empty needle knit. The term, "empty needle knit", means that a yarn is newly retained in a hook of a needle retaining no loop therein. In the course 8, the yarn is fed to the needles k, m, o of the back upper needle bed BU and the needles P–W of the front lower needle bed FD, to form the intermediate layer part 2*b*. In the courses 7 and 8, the needles of the back lower needle bed BD may be used, instead of the needles of the back upper needle bed BU. If the loops of the intermediate layer part 2*b* knitted in the half-gauge loop arrangement are formed to have the same size as the surrounding loops in FIG. 4, then sinker loops become large than the surrounding loops knitted in the full-gauge loop arrangement, so that the texture difference of the knitted fabric will be partly produced. For this reason, the loops of the intermediate layer part 2*b* formed to have such a size, narrower than the loops in other regions than the laminating part 4, (hereinafter it is called "tight loop stitch") so that when the sinker loops are absorbed in the needle loops after completion of the knitting, the loops of the intermediate layer part can be substantially equal in size to the remaining loops, to provide substantially the same texture as the loops other than those of the laminating layer part.

In the course 9, the loops of the intermediate layer part 2*b* on the back upper needle bed BU are transferred to the needles K, M, O of the front lower needle bed FD not to cause an obstruction to the knitting of the base layer part 2*c*. In the course 10, the back knitted fabric part 3*a* is knitted. In this course 10, the loops formed in the back knitted fabric part 3*a* (needles j, l, n of the back lower needle bed BD) confronting the laminating part 4 put in the half-gauge loop arrangement in the same manner as in the laminating part 4 are formed in the form of the tight loop stitch. JP Laid-open (Unexamined) Patent Publication No, Hei 8-60499 discloses a flat knitting machine capable of knitting tight loop stitches and normal loops larger than the tight loop stitches in the state of being mixed in a single course. In order to provide substantially the same texture between the tight loop stitches formed in the half-gauge loop arrangement and the normal loops formed in the full-gauge loop arrangement, it is desirable that the flat knitting machine can allow formation of the tight loop stitches and the normal loops with a further increased stitch density, In the course 11, the yarn is fed to the needles A–H and J, L, N, P of the front lower needle bed FD and to the needles i, k, m, o of the back lower needle bed BD, to form new loops of the back layer part 2*c*. In the course 12, the yarn is fed to the needles o, m, k, i of the back lower needle bed BD, to knit the back layer part 2*c* with the tight loop stitches, and also the yarn is fed to the needles H–A of the front lower needle bed FD to knit. As described above, in this embodiment, the surface layer part 2*a* and the intermediate layer part 2*b* are formed in the state of being jointed together continuously in the courses 7 and 8, and the surface layer part 2*a* and the back layer part 2*c* are formed in the state of being jointed together in the courses 11 and 12. Accordingly, the surface layer part 2*a*, the intermediate layer part 2*b*, and the back layer part 2*c* are closed at a lower end of the opening 5. In the course 13, prior to the knitting of the back knitted fabric part 3, the loops of the back layer part 2*c* are transferred to the front upper needle bed FU. In the course 14, the back knitted fabric part 3 is formed, while the loops of the part 3*a* confronting the laminating part 4 are knitted in the form of the tight loop stitches in the same manner as the course 10.

In the course 15, prior to the knitting of the surface layer part 2*a*, the loops of the intermediate layer part 2*b* are transferred to the back lower needle bed BD. In the course 16, prior to the knitting of the surface layer part 2*a*, the loops of the intermediate layer part 2*b* are transferred to the back upper needle bed BU. In the course 17, the needles W–P are used to form the loops of normal size and the loops of the surface layer part 2*a* in the tight loop stitch form. In the course 18, the loop is tucked in the needle P of the front lower needle bed FD and the interlayer part 2*b* on the back upper needle bed BU is knitted on a tight stitch loop basis. When the loop is tucked in the needle P, the surface layer part 2*a* and the intermediate layer part 2*b* are closed at right ends thereof and are formed in tubular form. In the course 19, the intermediate layer part 2*b* is knitted on the back upper needle bed on a tight stitch loop basis. In the course 20, the surface layer part 2*a* is formed on a tight stitch loop basis and the front knitted fabric part 2 is knitted with needles P–W. In the course 21, prior to the knitting of the back knitted fabric part 3, the loops of the intermediate layer part 2*b* are transferred to the front lower needle bed FD. In the course 22, the back layer part 2*c* is shifted to the front upper needle bed FU. In the course 23, the loops of the back knitted fabric part 3 confronting the laminating part 4 are knitted on a tight stitch loop basis. In the course 24, the loops of the back layer part 2*c* are transferred to the back lower needle bed BD. In the course 25, normal loops are formed with the needles A–H of the front lower needle bed and the back layer part 2*c* of the back lower needle bed are formed on a tight stitch loop basis. In the course 26 formed in the leftward knitting, the back layer part 2*c* is formed on a tight stitch loop basis and the normal loops are formed with the needles A–H of the front lower needle bed. Subsequently, the knitting processes of the courses 13–26 are repeatedly performed to knit the laminating part 4 and the back knitted fabric part 3 in the state of being laminated in four layers. In FIG. 1, the laminating part 4 is knitted to have front stitches at an uppermost part thereof, when the knitted fabric is viewed form the front. Also, it is knitted to have back stitches at a second-uppermost part thereof and is knitted to have back stitches at a third-uppermost part thereof. The back knitted fabric part 3*a* positioned on the fourth-uppermost side is knitted in back stitch.

Next, the knitting width narrowing step s6 of returning the loop arrangement of the laminating part 4 to the original full-gauge loop arrangement after completion of the formation of the laminating part 4 will be described with reference to the course 27 and subsequent courses. In the course 27, the loops of the intermediate layer part 2*b* are transferred to the back upper needle bed. In the course 28, after the back needle bed is racked leftward one pitch, the intermediate layer part is laminated on the surface layer part 2*a* on the front lower needle bed. In the next course 29, after the back needle bed is racked rightward one pitch, the back layer part 2*c* is laminated on the surface layer part 2*a* and intermediate layer part 2*b* on the front lower needle bed. In the courses 30 and 31, the laminating part 4 and the back knitted fabric part 3 confronting the laminating part 4 are formed on a tight stitch loop basis and the loops of the next courses are formed in the front knitted fabric part 2 and the back knitted fabric part 3, respectively. In the course 32, the loop of the laminating part 4 at the needle N of the front lower needle bed FD positioned at the right side of the line formed by the needles L and l positioned at the center of the laminating part 4 and the loop of the front knitted fabric part 2 positioned closer to the knitted fabric part than the laminating part 4 are transferred to the back upper needle bed BU. Likewise, the loop of the laminating part 4 at the needle i of the back lower needle bed BD positioned at the left side of the line formed by the needles L and l and the loop of the back knitted fabric part 3 positioned closer to the knitted fabric part than the laminating part 4 are transferred to the front upper needle bed FU (the loops of the laminating part 4 and the loops of the back knitted fabric part 3*a* hidden behind the laminating part 4 are depicted by black circles). In the course 33, after the back needle bed is racked leftward one pitch, the loop at the needle n of the back upper needle bed BU is transferred to the needle M of the front lower needle bed FD and the loop at the needle J of the front upper needle bed is transferred to the needle k of the back lower needle bed BD. In the course 34, the loops at the needles p-w of the back upper needle bed BU are transferred to the needles N–U of the front needle bed FD and the loops at the needles A–H of the front upper needle bed FU are transferred to the needles c–j of the back lower needle bed BD. In the course 35, the loops at the needles p–w of the back lower needle bed BD are transferred to the needles N–U of the front upper needle bed FU and, at the same time as this, the loops at the needle A–H of the front lower needle bed FD and the loop at the needle J are transferred to the needles c–j of the back upper needle bed BU and the needle l, respectively. In the course 36, after the back needle bed is racked leftward one pitch, the loop at the needle n of the back lower needle bed BD is transferred to the needle M of the front upper needle bed FU and the loop at the needle l of the back upper needle bed BU is transferred to the needle K of the front lower needle bed FD. In the course 37, after the back needle bed is returned to the 0 pitch, the loops at the needles M–U of the front upper needle bed FU are transferred to the needles m–u of the back lower needle bed BD and the loops at the needles c–k of the front lower needle bed FD are transferred to the needles C–J of the front lower needle bed FD. After the knitting processes mentioned above, the loop arrangement is returned to the full-gauge loop arrangement. In the subsequent courses from the course 38, the yarn is circularly fed to the both front and back needle beds, to form the knitted fabric part sequent to the laminating part 4 to thereby produce the tights 1 of FIG. 1.

As described above, the illustrated embodiment can allow the knitting of the knitted fabric without providing substantial texture difference between the laminating part 4 and the other knitted fabric parts than the laminating part 4. In addition, according to the embodiment of the invention, since the half-gauge loop arrangement is just used for only the part requiring the half-gauge knitting, the flat knitting machine can be shortened, as compared with the one used in the conventional knitting method using the half-gauge knitting for the whole knitted fabric. Also, this knitting can allow the knitting of a rib part with all needles and thus can provide an increased stitch density to produce a knitted fabric having nerve and excellent texture.

Figure 10:
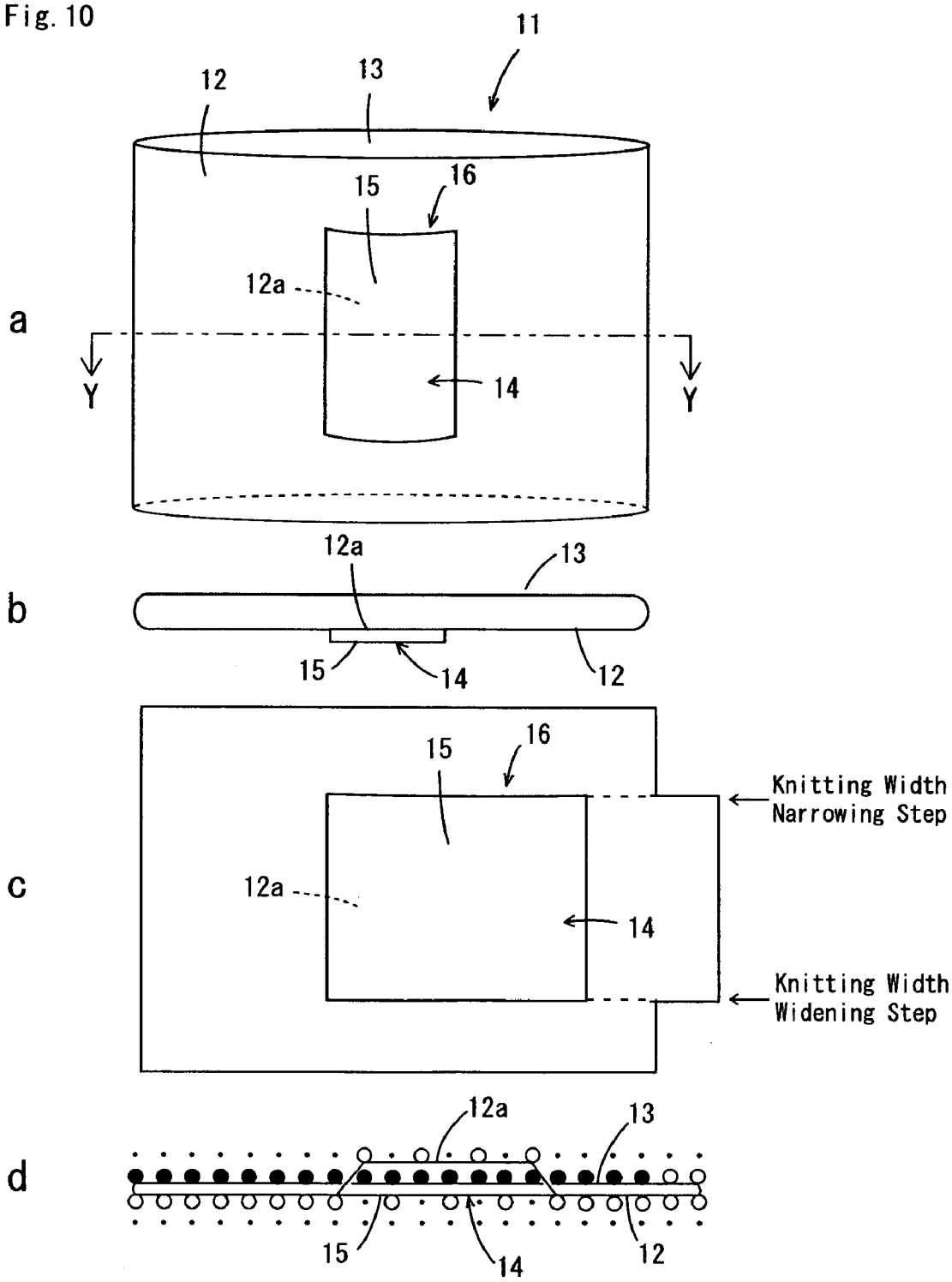
FIG. 10(*a*) shows a tubular knitted fabric 11 knitted in the second embodiment.
Figure 11:
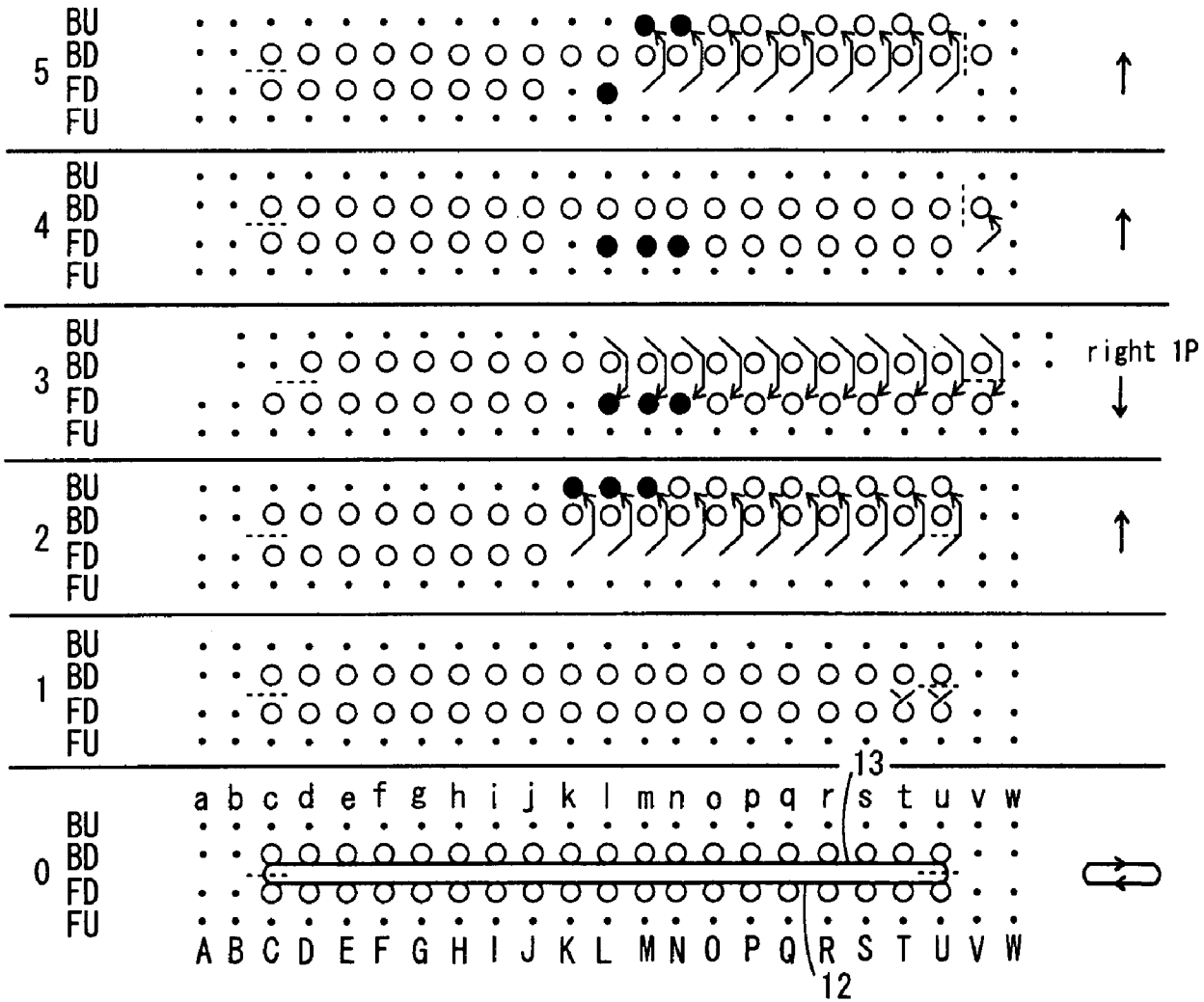
FIGS. 11–16 show knitting course diagrams illustrated in the second embodiment.
Figure 12:
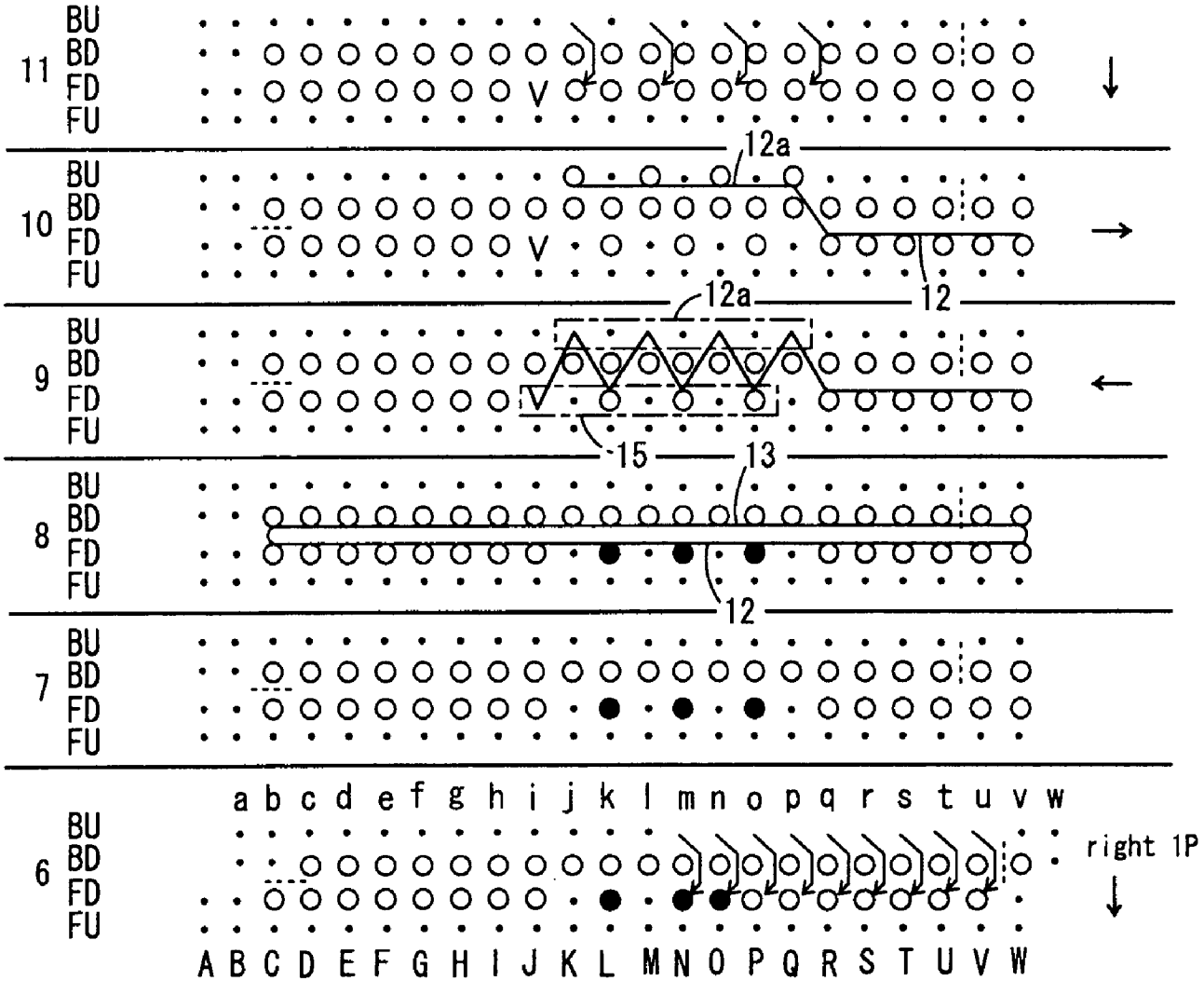
Figure 13:
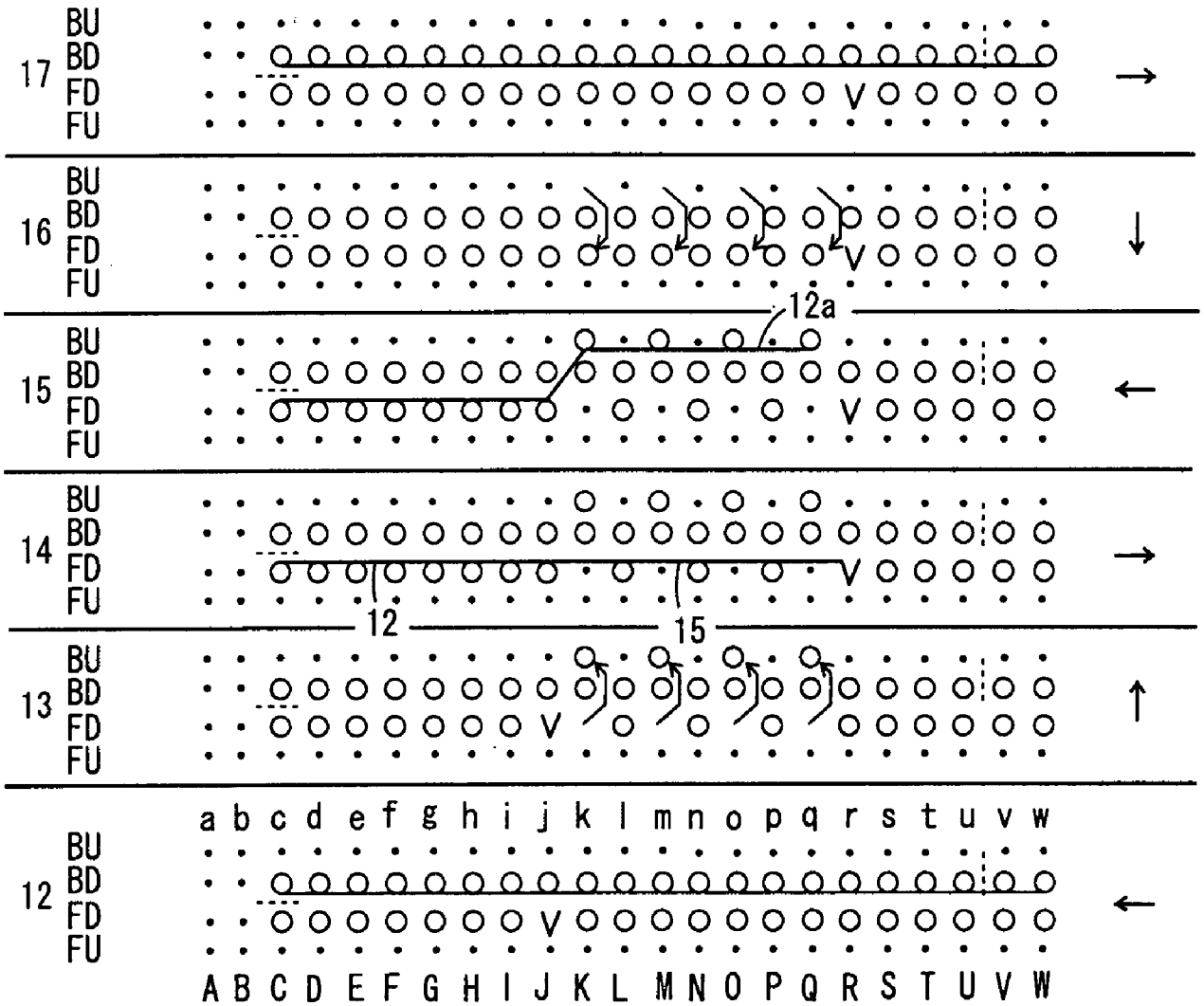
Figure 14:
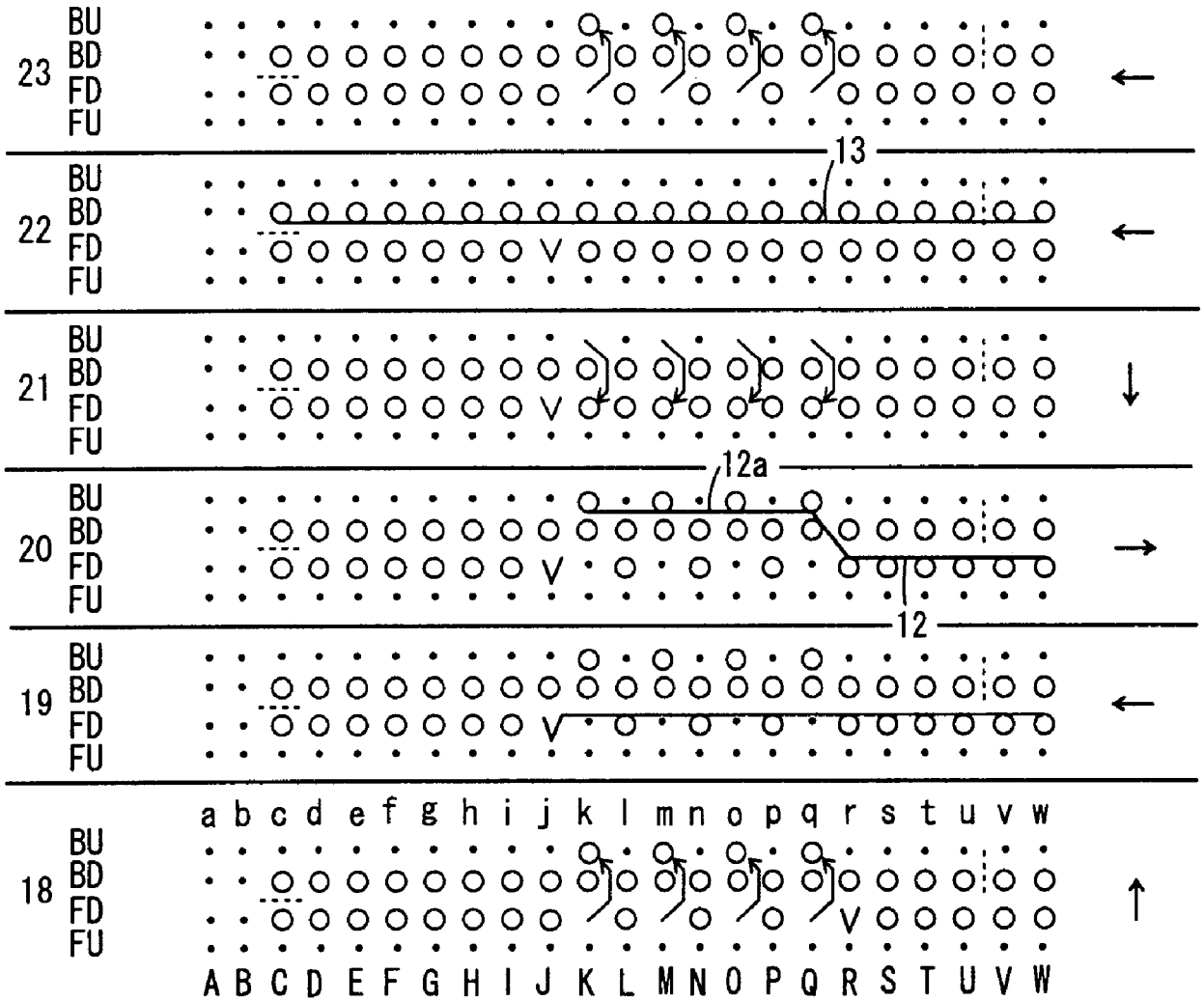
Figure 15:
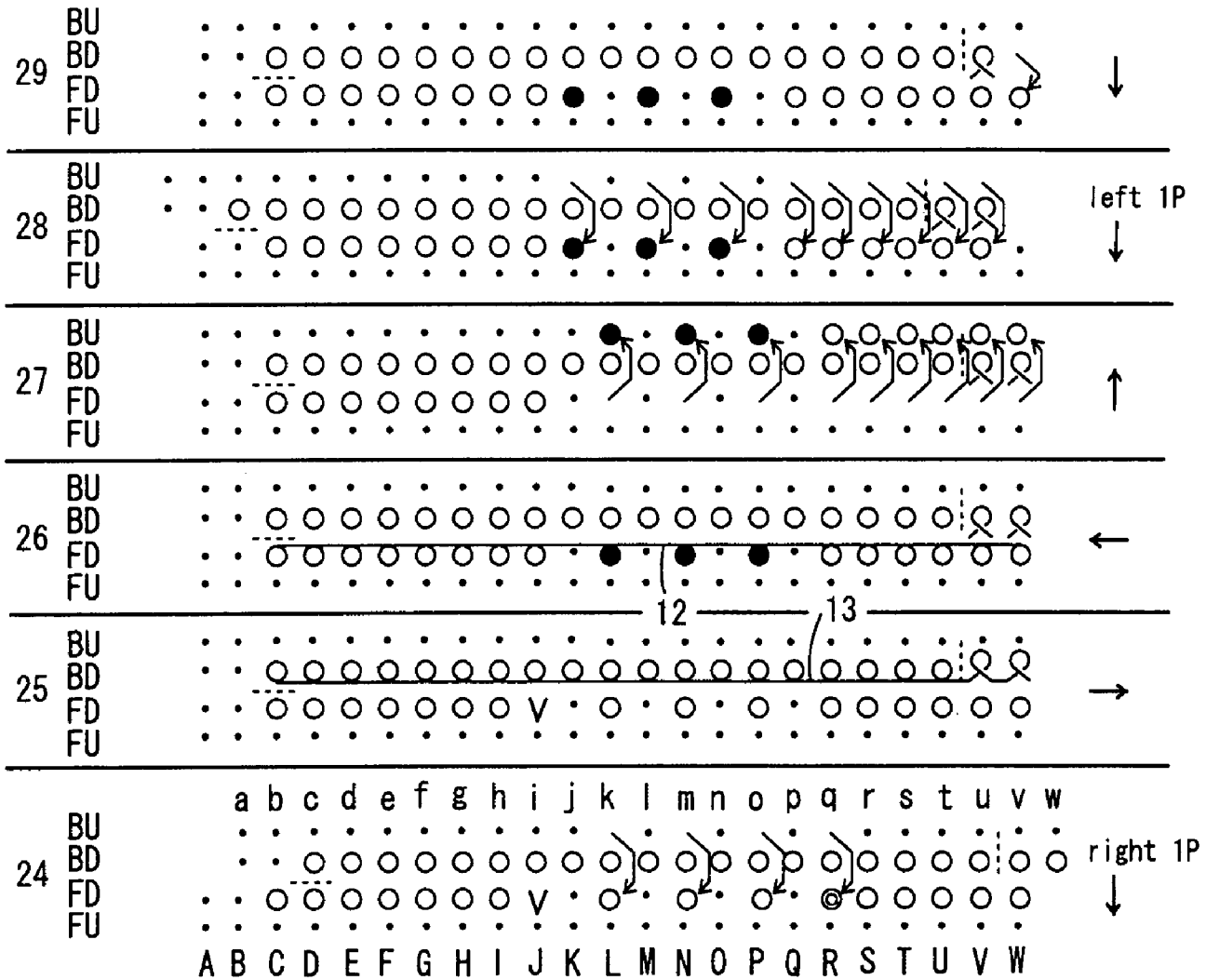
Figure 16:
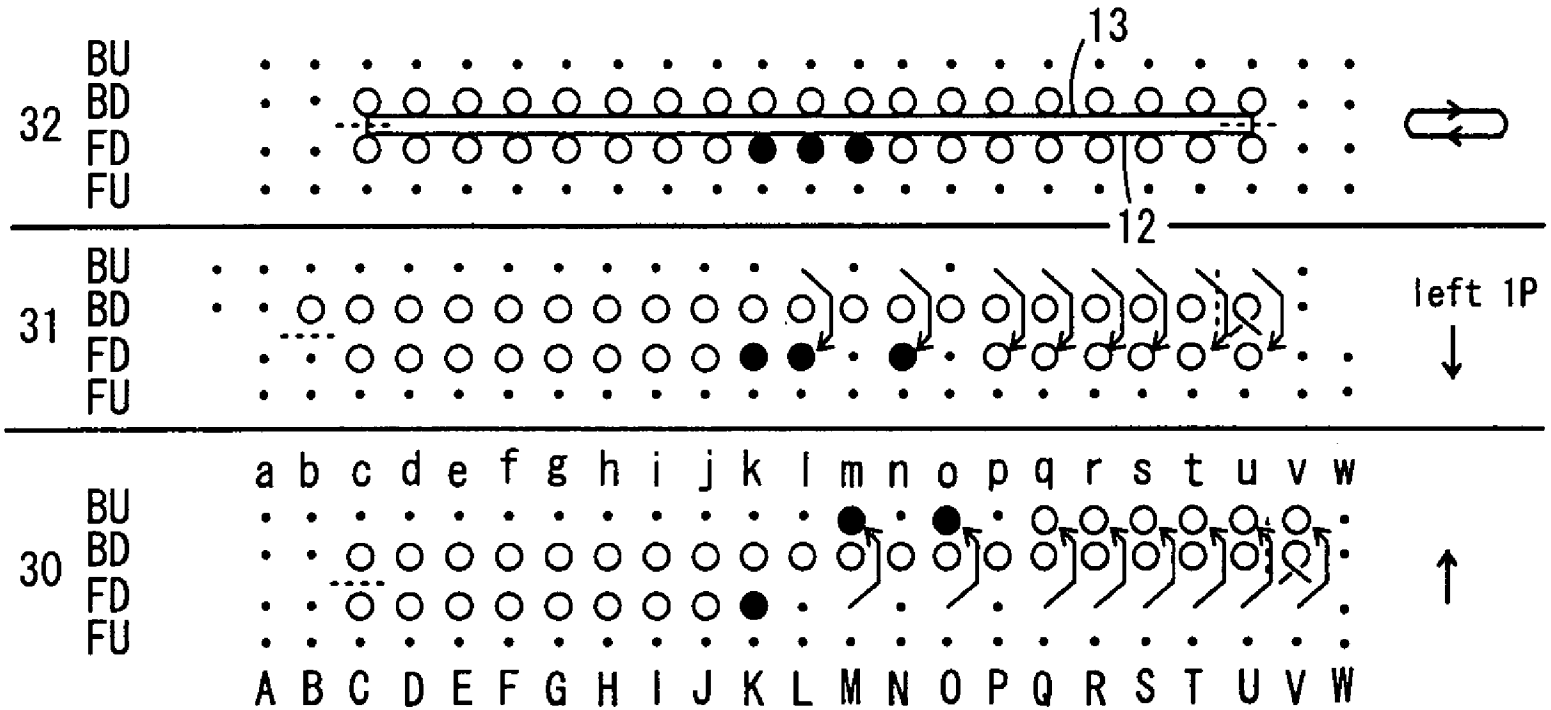

Next, the second embodiment will be described with reference to FIGS. 10–16. FIG. 10-*a* shows a tubular knitted fabric 11 knitted in the second embodiment. FIG. 10-*b* shows a sectional view of FIG. 10-*a* taken along line Y—Y as viewed from an arrowed direction. FIG. 10-*c* shows change in knitting width of the tubular knitted fabric 11 of FIG. 10-*a* on the needle bed. FIG. 10-*d* shows a loop arrangement for knitting a laminating part. In the second embodiment, the course 0 corresponds to the step s1; the courses 1–8 correspond to the knitting width widening step s3; the courses 9–23 correspond to the step s4; the courses 24–31 correspond to the knitting width narrowing steps s6; and the course 32 corresponds to the step s7. A tubular knitted fabric 11 is knitted in tubular form wherein a front knitted fabric part 12 and a back knitted fabric part 13 are continuously joined together at both ends thereof.

Although a knitted fabric of the second embodiment can be knitted by the knitting method of the first embodiment, the knitted fabric of the second embodiment is knitted by a knitting method that can decrease the number of loops formed via the half-gauge loop arrangement and the number of needles required for the formation of second stitch loop, requiring a decreased number of needles for the knitting. In the second embodiment, the knitted fabric is formed in three layers in total at the laminating part, having the back knitted fabric part formed as a first layer and the front knitted fabric part formed as a second layer. A pocket 14 corresponding to the multilayered part of the first embodiment is formed in the front knitted fabric part 12. In the pocket forming part of the fabric, a pocket part 15 is formed in the state of being laminated on the front knitted fabric part 12*a* (hereinafter it is called "interior knitted fabric part of the pocket") hidden behind the pocket part 15 and is combined with the back knitted fabric part 13, to form a three-layer knitted fabric part. The second embodiment is characterized in that only the pocket part is formed via the half-gauge loop arrangement and the back knitted fabric part 13 hidden behind the pocket 14 is knitted via the full-gauge loop arrangement as was used.

In the following, the second embodiment will be described with reference to FIGS. 11–16. The course 1 of FIG. 11 indicates the knitting courses before the knitting width widening step s3 starts. A broken line between the needles C and c of the front and back needle beds and a broken line between the needles U and u indicate the boundary line between the front knitted fabric part 12 and the back knitted fabric part 13. In the course 1, a specified number of loops positioned at the right end of the front knitted fabric part are changed in yarn feed direction, so that the respective loops are formed in the form of one-half twisted loops. The number of loops formed in the form of the twisted loops are the same as the number of loops transferred to the outside of the back knitted fabric part 13 when a circular feed knitting is performed as mentioned later. The direction in which the loops are twisted is opposite to the direction in which the loops are twisted in the circular feed knitting is performed. In the course 2, the loops of the laminating part 14 and the loops positioned closer to the side end of the knitted fabric than the laminated part 14 are transferred to the back upper needle bed BU. Then, after the back needle bed is racked rightward one pitch, the loops are transferred back to the original needle bed. In the course 4, the loop at the right end of the front knitted fabric part 12 retained on the front needle bed is transferred to the outside of the loops at the right end of the back knitted fabric part 13 retained on the back needle bed. This loop transference is carried out, in order to prevent possible yarn breakage which may be caused by the loop at the side end of the front knitted fabric part 12 and the loop at the side end of the back knitted fabric part 13 being excessively distanced away from each other when the laminating part 14 of the front knitted fabric part 12 is put in the half-gauge loop arrangement. Since the loops thus transferred are formed in the state of being pre-twisted in the opposite direction so that when transferred, the loops are released from the twist.

In the next course 5, the loops of the pocket 14 and the loops positioned at the outside of the pocket 14 are transferred to the back needle bed. Then, after the back needle bed is racked rightward one pitch, all loops on the back upper needle bed BU are transferred to the front lower needle bed FD. Subsequently, the knitting processes of the courses 2–6 are repeated until the course 7 in which the laminating part 14 is in the half-gauge loop arrangement, then completing the knitting width widening step. At this time, the pocket 14 is in the half-gauge loop arrangement, and the remaining parts are in the full-gauge loop arrangement. In the sequent course 8, the loops of the pocket 14 are formed in the form of tight stitch loop finer than the loops other than the pocket 14 so that the loops of the pocket 14 can provide the same texture as the loops other than those of the pocket 14 can do at the completion of the knitting of the knitted fabric, and the yarn is fed to the whole knitted fabric. In the course 9, in order to form new loops to form the interior knitted fabric part of the pocket, the yarn is fed to the needles W–R of the front needle bed, the needles P, N, L, J of the front needle bed, and the needles q, o, m, k of the back needle bed. The needle J is used for tuck, the needles q, o, m, k are used for the empty needle knit, and the remaining needles are used for the knit.

In the course 10, the loops of the interior knitted fabric part 12*a* of the pocket are formed in the form of the tight stitch loop and a right side of the front knitted part 12 is knitted. In the course 11, prior to the knitting of the back knitted fabric part 13, the loops of the interior knitted fabric part 12*a* are transferred to the front lower needle FD. In the course 12, the back knitted fabric part 3 and part of the front knitted fabric part 12 circularly fed onto the back needle bed are formed to have a normal size. In the course 13, the loops of the interior knitted fabric part 12*a* are transferred to the back upper needle bed FD. In the course 14, the loops of a left side of the front knitted fabric part 12 are formed to have a normal size and the pocket 12 is knitted on a tight-stitch-loop basis. In the course 15, the loops of the interior knitted fabric part 12*a* of the pocket are formed in the form of the tight stitch loop and the left side of the front knitted part 12 is knitted in the form of the normal loop having a normal size. In the course 16, the loops of the interior knitted fabric part 12*a* of the pocket are transferred to the front lower needle bed FD. In the course 17, the back knitted fabric part 13 and the front knitted fabric part circularly fed are knitted. In the course 18, the loops of the interior knitted fabric part 12*a* of the pocket are transferred to the back upper needle bed BU. In the course 19, the loops of the pocket part 15 are formed in the tight stitch loop and the loops of the right side of the front knitted fabric part 12 are knitted in the normal loop. In the course 20, the loops of the pocket part 15 are formed in the tight stitch loop and the loops of the right side of the front knitted fabric part 12 are knitted in the normal loop. In the course 21, the loops of the interior knitted fabric part 12*a* of the pocket are transferred to the front lower needle bed FD and, in the course 22, the back knitted fabric part is knitted. Subsequently, the knitting processes of the courses 13–22 are repeated until the three-layer laminating part 14 is formed.

In the course 23, after the loops of the interior knitted fabric part 12*a* of the pocket are transferred to the back upper needle bed, the loops of the final course of the pocket part 15 are subjected to a binding-off process, not shown, to prevent loosening of the loops and, then, released from the needles. In the course 24, the loops of the interior knitted fabric part 12*a* of the pocket are transferred to the lower needle bed. From the course 25, the knitting width narrowing step of bringing the pocket 14 back to the full-gauge loop arrangement starts. In the course 25, the loops of the back knitted fabric part 13 and the loops of the front knitted fabric part 12 circularly fed onto the back needle bed are formed. In this process, when the loops of the front knitted fabric part 12 are formed, the yarn feeding direction is changed and the loops are formed in such a manner as to be twisted in an opposite direction to a direction for the loops to be twisted when the circular feed knitting is performed at a later stage. In the course 26, a single course of the front knitted fabric part 12 is knitted. In the course 27, the loops of the pocket 14 and the loops positioned closer to the side end of the knitted fabric than the pocket 14 are transferred to the back upper needle bed BU. In the course 28, after the back needle bed is racked leftward one pitch, those loops are transferred to the front needle bed. In the course 29, the loop at the right side end of the knitted fabric on the back lower needle bed is transferred to the outside of the loop at the right end of the front upper bed. This knitting is the circular feed knitting of preventing the loops of the knitted fabric part retained on the front bed and the loops of the knitted fabric part retained on the back needle bed being excessively distanced away from each other. In the course 30, the loops of the pocket 14 and the loops positioned closer to the outside than the pocket 14 are transferred to the back upper needle bed BU and then are transferred to the front lower needle bed FD in the course 31. The knitting processes shown in the courses 27–31 are repeated and thereby the loops of the pocket 14 are returned to the full-gauge loop arrangement, as in the course 32. Subsequently, in the course 32, the yarn is circularly fed to the both front and back needle beds to form the subsequent knitted fabric part to the pocket 14. The tubular knitted fabric 11 is completed in the manner described above.

The knitting methods of the embodiments of the present invention are applicable to other knitted fabric parts than those illustrated in the embodiments above, including a placket of a polo shirt and a sweater. Although the embodiments wherein the knitted fabric is knitted by plain knitting have been described above, this knitted fabric may be knitted by rib knitting. Any variations and modifications as fall within the range persons in the art can easily think of may be made. Although the embodiments wherein the knitted fabric is formed in tubular form have been described above, for example a not-completely-tubular knitted fabric, such as a body of a cardigan, may be knitted by the knitting method of the invention. Although the examples using the four-bed flat knitting machine have been illustrated in the embodiments mentioned above, the knitted fabric can also be knitted by a two-bed flat knitting machine. Also, although the embodiments wherein the knitting width widening step is taken at the starting point of the knitting of the multilayer part have been described above, the knitting width widening step may be taken before the knitting of the multilayer part. Further, although the embodiments wherein the knitting width narrowing step is taken at the completion of the knitting of the multilayer part have been described above, even after completion of the knitting of the multilayer part, the knitting may go on to the end without taking the knitting width narrowing step.

What is claimed is:

1. A method of knitting a tubular knitted fabric comprising a first knitted fabric and a second knitted fabric joined together continuously at both ends thereof, and a laminating part formed in the first knitted fabric at which the knitted fabric is partly laminated in at least two layers by using a flat knitting machine comprising having at least a pair of front and back needle beds which extend laterally and are arranged opposite to each other and have a large number of needles respectively and at least one of which can be racked rightward and leftward to transfer loops between the needles beds, the method comprising:

1) the step of forming the tubular knitted fabric via a full-gauge loop arrangement, 2) the knitting width widening step of shifting loops of wale where the laminating part is formed and loops of wale positioned closer to a side end of the knitted fabric than the wale where the laminating part is formed, to provide a half-gauge loop arrangement wherein empty needles for stitch transfer are arranged between needles used for forming the loops of the wale where the laminating part is formed, and 3) the step of knitting the first knitted fabric and the second knitted fabric, while the loops of wale where the laminating part is formed are formed to be fine in size so that when the knitting is ended, the loops of wale where the laminating part is formed can be substantially equal in size to the loops in other regions than the wale where the laminating part is formed, to provide the same texture as the loops other than those of the laminating layer part.

2. The method of knitting the tubular knitted fabric according to claim 1, wherein in the knitting width widening step, the loops of wale where the laminating part is formed and the loops positioned closer to a side end of the knitted fabric than the wale where the laminating part is formed are shifted at a location at which formation of the laminating part starts, so that the loops of wale where the laminating part is formed are put in the half-gauge loop arrangement wherein the empty needles for stitch transfer are arranged between the needles used for forming the loops of the wale where the laminating part is formed.

3. The method of knitting the tubular knitted fabric according to claim 1, wherein, after completion of the knitting of the laminating part, a knitting width narrowing step is taken to return the loops of the laminating part to the full-gauge loop arrangement.

4. The method of knitting the tubular knitted fabric according to claim 1, wherein the loops of wale where the laminating part of the first knitted fabric is formed; the loops positioned closer to the side end of the knitted fabric than the wale where the laminating part is formed; loops of wale at a portion thereof confronting the laminating part of the second knitted fabric; and the loops of wale positioned closer to the side end of the knitted fabric than the wale at a portion thereof confronting the laminating part are transferred to their respective opposite needle beds and then at least any one of the front and needle beds is racked, so that whenever racked a predetermined pitch, the loops of wale where the laminating part of the first knitted fabric is formed and the loops of wale at a portion thereof confronting the wale where the laminating part of the second knitted fabric is formed are returned to their respective original needle beds, so that the loops of the wale where the laminating part is formed and the loops of wale at the portion thereof confronting the laminating part are put in the half-gauge loop arrangement.

5. The method of knitting the tubular knitted fabric according to claim 1, wherein the knitting width widening step and/or the knitting width narrowing step includes the feed knitting step that loops of the knitted fabric on the side thereof on which the knitting width is larger or will be larger are sequentially transferred to respective positions at the outside of the loops at the side end of the knitted fabric retained on the other needle bed from the loop at the side end of the knitted fabric and then the loops are shifted to prevent increase of difference in knitting width between the first knitted fabric and the second knitted fabric.

* * * * *